US005092294A

United States Patent [19]

Jackson

[11] Patent Number: 5,092,294

[45] Date of Patent: Mar. 3, 1992

[54] METHOD AND APPARATUS FOR DEFUELING A VEHICLE

[75] Inventor: Christopher L. Jackson, Kingwood, Tex.

[73] Assignee: GSL Investments, Inc., Houston, Tex.

[21] Appl. No.: 684,522

[22] Filed: Apr. 11, 1991

[51] Int. Cl.[5] ..... F02B 77/00

[52] U.S. Cl. ..... 123/198 C; 137/571

[58] Field of Search ..... 123/198 A, 198 C, 510, 123/198 DB, 456; 137/570, 571, 590; 134/169 A; 180/69.4, 313, 314

[56] References Cited

U.S. PATENT DOCUMENTS

| | | | |
|---|---|---|---|
| 4,183,498 | 1/1980 | Hajek, II et al. | 137/571 |
| 4,340,023 | 7/1982 | Creager | 123/510 |
| 4,515,125 | 5/1985 | Buck et al. | 123/198 DB |
| 4,595,030 | 6/1986 | Yazaki | 137/590 |
| 4,747,429 | 5/1988 | Sundstrom, Jr. | 180/314 |

*Primary Examiner*—Noah P. Kamen
*Attorney, Agent, or Firm*—Fulbright & Jaworski

[57] ABSTRACT

A method of defueling a vehicle having a fuel tank, an electric fuel pump includes connecting a hose to the fuel system downstream of the fuel tank and electrically connecting the fuel pump to the battery. In a multiport fuel injected engine, the hose connection is to the fuel pressure gauge test point. In a throttle body fuel injection unit, the injector is removed and a dummy injector having an outlet is installed.

5 Claims, 3 Drawing Sheets

FIG.2
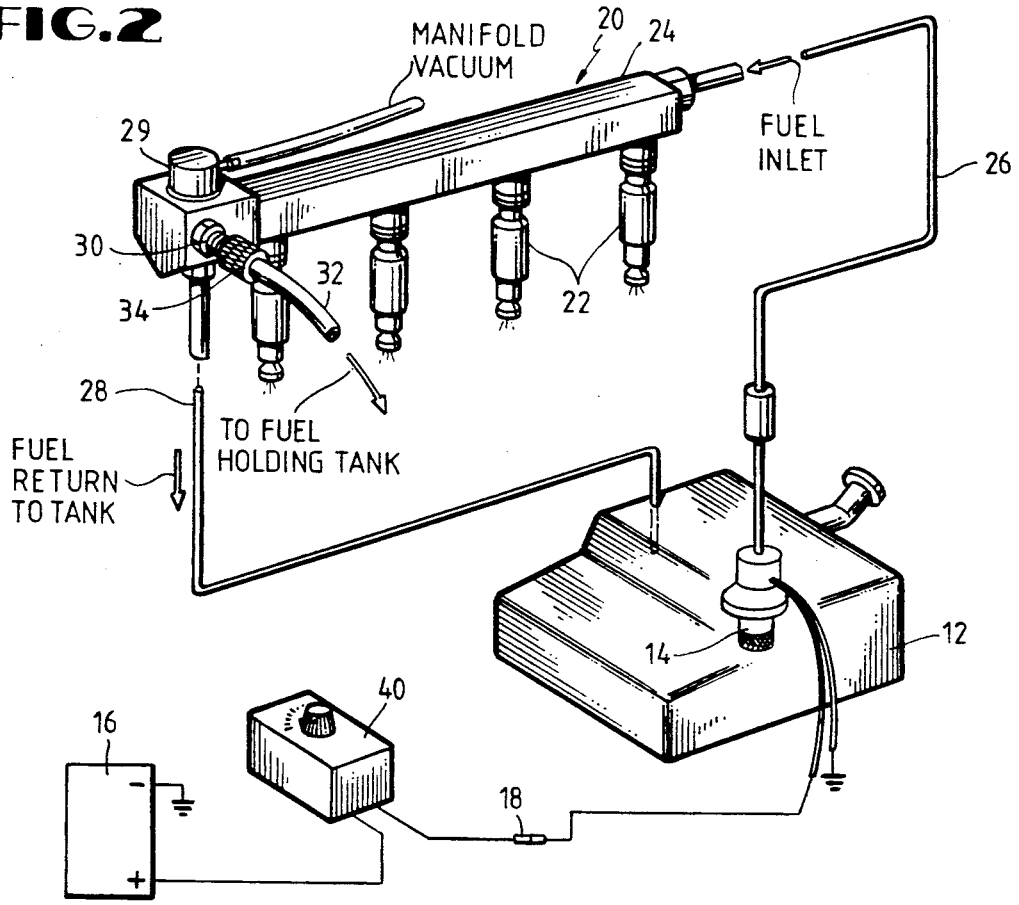
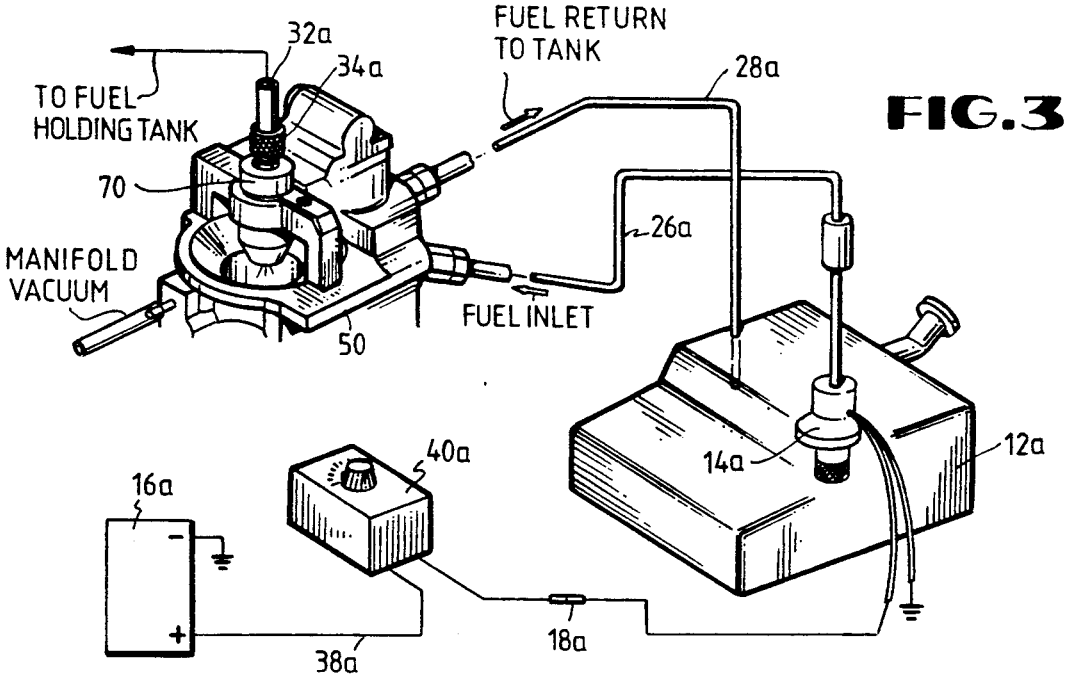
FIG.3

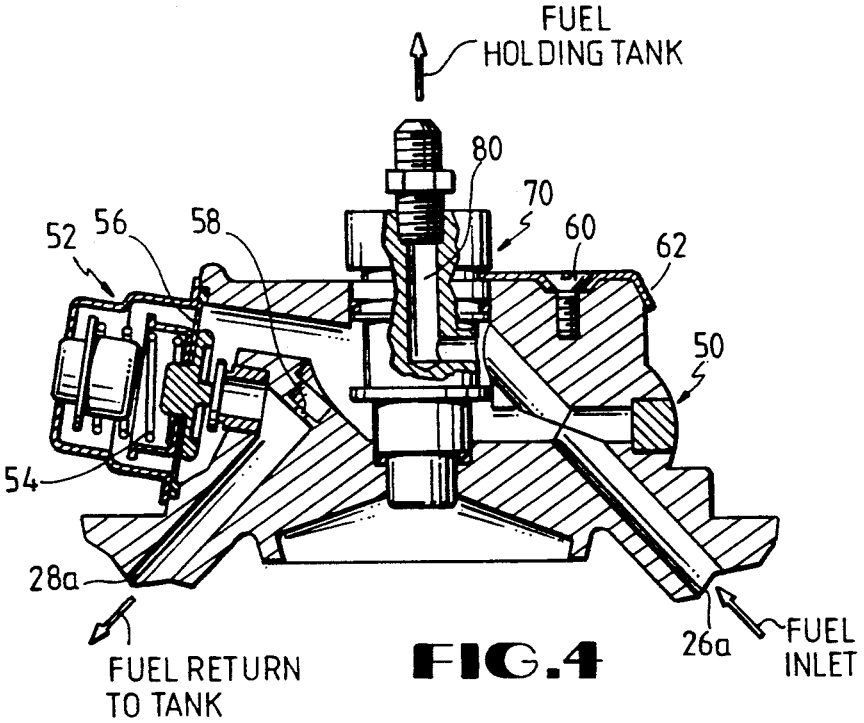
FIG.4
FIG.5
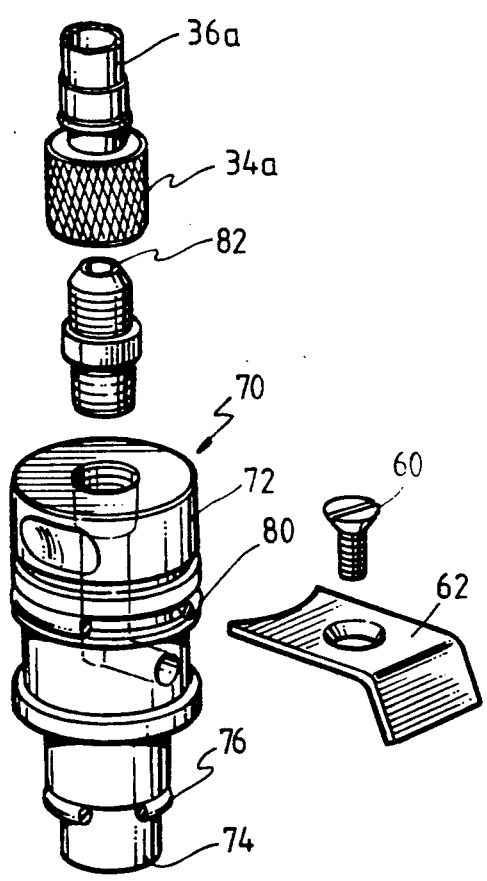

METHOD AND APPARATUS FOR DEFUELING A VEHICLE

BACKGROUND OF THE INVENTION

It is frequently desirable to defuel a vehicle, that is, remove all or part of the fuel from the fuel tank, such as when changing the fuel tank, replacing a sending unit in the fuel tank, or in the case of car rental companies, of reselling the automobiles.

While it is possible in some automobiles to put a hose in the gas filler neck and pump fuel out of the tank into a holding fuel tank, this will not work in many cars. That is, many cars have an anti-rollover valve built in the filler neck which would not allow a hose to be inserted in the fuel tank. Therefore, most manufacturers have a complicated procedure which must be followed in draining the fuel tank.

The present invention is directed to a method and apparatus for quickly and safely removing some or all of the fuel from a vehicle which can be done quickly and safely.

SUMMARY

The present invention is directed to a method of defueling a vehicle having a fuel system including a fuel tank, an electric fuel pump, and a battery. The method includes connecting a hose to the fuel system downstream of the fuel tank, and electrically connecting the fuel pump to a battery for pumping fuel from the fuel tank through the hose.

Yet a still further object of the present invention is wherein the vehicle includes a fuel pump test lead in the engine compartment and wherein the step of electrically connecting the fuel pump includes electrically connecting the test lead to the battery. Preferably, the test lead is connected to the battery through a timer.

Yet a still further object of the present invention is wherein the vehicle includes a multi-fuel port injected engine with a fuel pressure gauge test point and the method includes connecting the hose to the fuel pressure gauge test point thereby avoiding opening any fuel lines.

Still a further object of the present invention is wherein the vehicle includes a throttle body fuel injection unit having a fuel injector and the method includes removing the injector from the unit and installing a dummy injector having an outlet into the unit with the hose connected to the outlet.

Still a further object of the present invention is the provision of a dummy fuel injector for replacing the fuel injector in a throttle body fuel injection engine in a vehicle for allowing defueling of the vehicle. The dummy includes a body having a size and shape to be installed in place of the fuel injector, the body has means blocking passage of fuel to the engine, the body includes a passage for receiving fuel supplied to the engine, and an outlet is connected to the passage for connecting to a defueling hose.

Other and further objects, features and advantages will be apparent from the following description of presently preferred embodiments of the invention, given for the purpose of disclosure and taken in conjunction with the accompanying drawings.

BRIEF DESCRIPTION OF THE DRAWINGS

FIG. 2 is a fragmentary schematic perspective elevational view illustrating the defueling of a multiport fuel injected vehicle, FIG. 3 is a fragmentary schematic perspective elevational view illustrating the defueling of a throttle body injection engine, FIG. 4 is an enlarged fragmentary cross-sectional view of a dummy injector of the present invention in place of the normal fuel injector in a throttle body injection unit, and FIG. 5 is an exploded elevational perspective view of the dummy fuel injector of FIG. 4.

DESCRIPTION OF THE PREFERRED EMBODIMENT

Figures 1A, 1B:
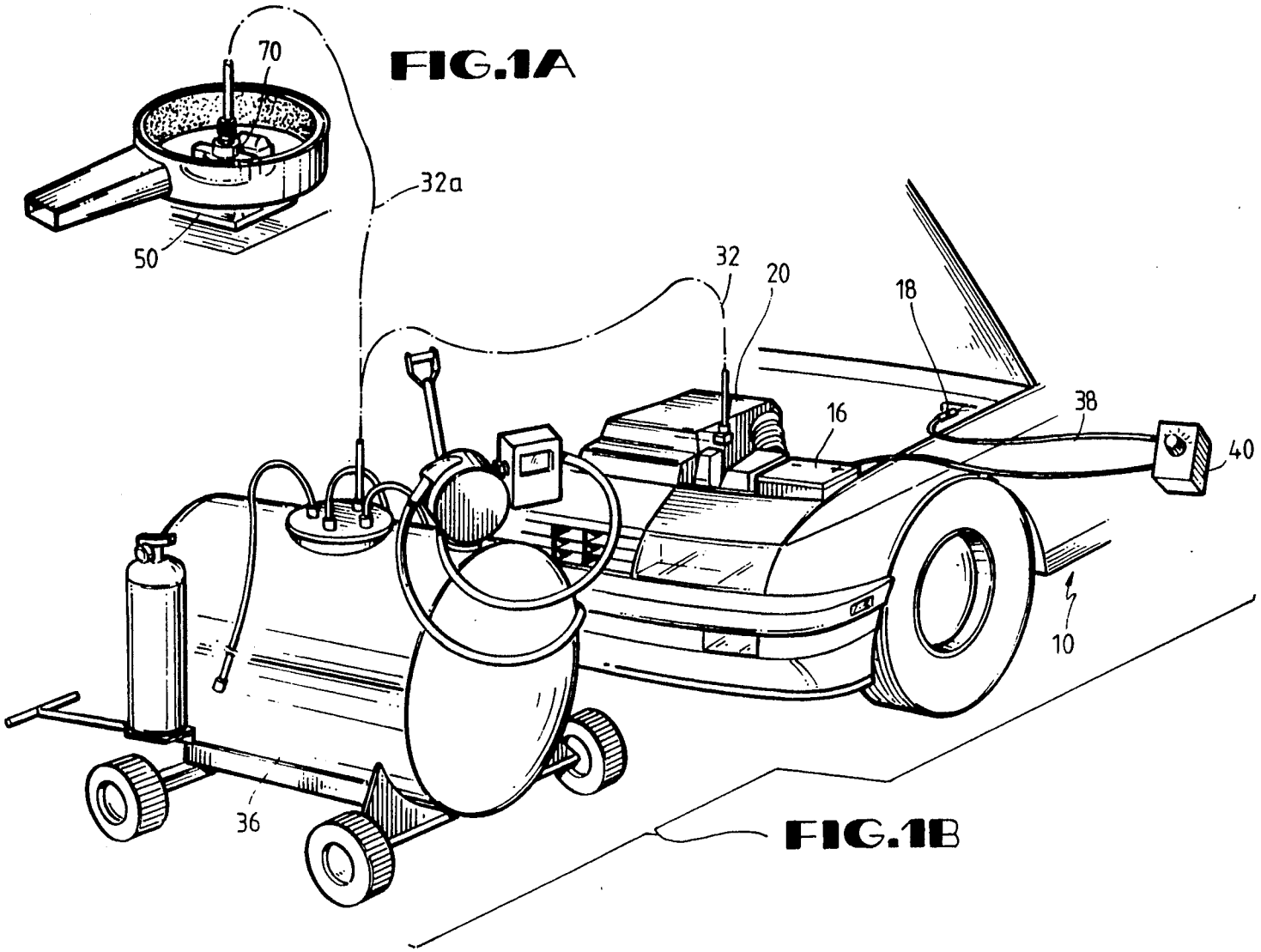
FIG. 1A is a fragmentary elevational perspective view of the apparatus of the present invention in use defueling one type of vehicle.
FIG. 1B is a fragmentary elevational prespective view illustrating the defueling of a different type of vehicle.

Most car rental companies sell their cars back to the manufacturer periodically. At the time of resale they are generally full of fuel. In order to recover some of the fuel costs, it is desirable to defuel the cars down to a minimum amount. Other reasons for defueling a car is to change the fuel tank or to perform other work thereon. However, most cars have an anti-rollover valve built in the filler neck which prevents the use of siphoning or pumping fuel out of the filler neck.

The present invention is directed to an apparatus and method for defueling vehicles, particularly later model vehicles having electric fuel pumps, which are generally mounted in the fuel tank or under the car.

In particular, the present method is of particular use in late model vehicles having either a multiport fuel injection engine or a throttle body injection engine. In addition, the electrical fuel pumps are 12-volt pumps and generally include a test lead or relay located in the engine compartment to power up the fuel pump for pressure testing.

The present invention is generally directed to connecting a hose with a holding tank for fuel to the vehicle fuel system downstream of the fuel tank, and electrically connecting the fuel pump to the battery for pumping fuel from the fuel tank through the hose and into the holding tank.

Referring now to FIGS. 1A and 2, the reference numeral 10 generally indicates a vehicle 10, such as the multiport fuel injection engine 20 vehicle, having a fuel tank 12, an electric fuel pump 14, and a battery 16, and a test lead, relay or power lead 18, normally located in the engine compartment. The multiport fuel injection engine 20 includes a plurality of injectors 22 connected to a fuel rail assembly 24 which receives fuel from the fuel pump 14 through a line 26 and excess fuel from pressure regulator 29 is returned through a line 28 back to the tank 12.

In addition, the multiport fuel injection engine 20 includes a fuel pressure gauge test point 30 located on the fuel rail assembly 24. The present invention is directed to removing the dust cap from the fuel gauge test point 30 and connecting a hose 32 having a compatible connection with the test point 30 such as a conventional shrader valve 34. The hose 32 is connected to a suitable fuel holding tank 36 such as a 100 gallon tank. In addition, the fuel pump 14 is electrically connected to the battery 16 such as by an electrical jumper cable 38 making an electrical connection between the battery 16 and the fuel pump test lead 18. Preferably, the jumper connection 38 includes a timer 40. Therefore, knowing the amount of fuel in the tank 12, the capacity of the fuel pump 14, the timer 40 may be set to remove the desired amount of fuel from the fuel tank 12. The holding tank 36 is suitably constructed to meet applicable Fire Department regulations and may have a plurality of hoses 32 for simultaneously defueling a plurality of vehicles. While the connection of the hose 32 to the fuel system of the vehicle 10 can be in any portion of the fuel line downstream of the fuel tank 12, such as by disconnecting a fuel inlet line, such a procedure is dangerous due to fuel spillage. The present method of defueling the vehicle through the fuel pressure gauge test point is preferable and safer.

While the foregoing method and apparatus work well with multiport fuel injection engines 20, other types of vehicles, such as throttle body injection engines, do not have test ports to allow fuel to be pumped from the engine at this point.

Referring now to FIGS. 1B, 3, 4 and 5, the method and operation of defueling a throttle body fuel injection engine is best seen wherein like parts to those described in connection with FIGS. 1A and 2 are similarly numbered with the addition of the suffix "a".

Again, of course, a vehicle with a throttle body injection unit will include a fuel tank **12*a*, an electric fuel pump 14*a*, a fuel pump test lead 18*a*, generally in the engine compartment, and a battery 16*a*. However, the throttle body injection unit 50 will generally include a fuel injector (not shown) for injecting pressurized fuel into the throttle bore, a pressure regulator 52 (FIG. 4) which includes a regulator spring 54 acting to close the fuel return and a pressure diaphragm 56 which opens the regulator 52 upon a pressure differential for maintaining a constant fuel pressure drop on the injector. In addition, a pressure relief orifice 58 bypasses the regulator 52** for providing a bleed off.

The throttle body injection unit 50 is electrically operated similarly to multiport engine 20 for defueling. That is, a jumper cable **38*a* is connected between the battery 16*a* and the test lead 18*a* to energize the fuel pump 14*a* to pump fuel from the tank 12*a* into the fuel inlet line 26*a***.

However, in order to make a fuel connection to the unit 50, the normal fuel injector is removed by unloosening a screw 60 (FIGS. 4 and 5) for loosening a clamp 62 and removing the fuel injector. Thereafter, a dummy injector 70 is installed in the place of the fuel injector and held in place by the clamp 62 and screw 60. The dummy injector 70 includes a body 72 which is sized and shaped to be installed in the place of the conventional fuel injector. However, the body 72 includes means, such as a blanking plug 74, and O-ring 76, forming means for blocking the passage of fuel into the engine cylinders. Instead, the body 72 includes a passageway 80 in communication with the fuel inlet **26*a* and leading out of the top of the body 72 to provide an outlet 82 for connection to a connector 34*a* and the fuel hose 32*a*. The hose 32*a* is also connected to the fuel holding tank 36**.

Therefore, when the dummy insert 70 is inserted, as best seen in FIGS. 3 and 4, and the fuel pump **14*a* is actuated, fuel is passed through the line 26*a* to the dummy injector 70 and to the pressure regulator 52. However, since the outlet 82 of the dummy injector 70 will receive and transmit the pressurized fuel to the holding tank 36, there is no pressure against the diaphragm 56 of the regulator 52 sufficient to open the regulator 52. Therefore, the incoming fuel is pumped to the holding tank 36 as the pressure regulator 52** remains closed.

When the tank **12*a* is defueled to the extent desired, the electrical jumper connection 38*a* is removed, the dummy injector 70** is removed, and the normal fuel injector is replaced.

The present invention, therefore, is well adapted to carry out the objects and attain the ends and advantages mentioned as well as others inherent therein. While presently preferred embodiments of the invention have been given for the purpose of disclosure, numerous changes in the details of construction, arrangement of parts, and steps of the process, will be readily apparent to those skilled in the art and which are encompassed within the spirit of the invention and the scope of the appended claims.

What is claimed is:

1. A method of defueling a vehicle having a fuel system including a fuel tank, an electric fuel pump, and a battery comprising, connecting a hose to the fuel system downstream of the fuel tank, electrically connecting the fuel pump to a battery for pumping fuel from the fuel tank through the hose, said vehicle includes a throttle body fuel injection unit having a fuel injector, and removing the injector from the unit, installing a dummy injector having an outlet into the unit with said hose connected to the outlet.

2. A method of defueling a vehicle having a multiport fuel injected engine having a fuel pressure gauge test point and a fuel tank, an electric fuel pump, a fuel pump power lead, and a battery comprising, connect a hose with a fuel holding tank to the fuel pressure gauge test point, and electrically connecting the fuel pump power lead to the battery thereby pumping fuel from the fuel tank through the hose into the holding tank.

3. A method of defueling a vehicle having a throttle body fuel injection unit having a fuel injector, a fuel tank, an electric fuel pump, a fuel pump power lead, and a battery comprising, removing the fuel injector, installing a dummy injector having an outlet into the place of the fuel injector, connecting a hose with a fuel holding tank to the dummy injector outlet, and electrically connecting the fuel pump power lead to the battery thereby pumping fuel from the fuel tank through the hose into the holding tank.

4. The method of claim 3 wherein the dummy injector blocks passage of fuel to the engine.

5. A dummy fuel injector for replacing the fuel injector in a throttle body fuel injection engine in a vehicle for allowing defueling of the vehicle comprising, a body having a size and shape to be installed in place of the fuel injector, said body having means blocking the passage of fuel to the engine, said body having a passage for receiving fuel supplied to the engine, and an outlet connected to the passage for connection to a defueling hose.

* * * * *